US007611116B2

(12) United States Patent
Santa Cruz et al.

(10) Patent No.: US 7,611,116 B2
(45) Date of Patent: Nov. 3, 2009

(54) DECORATIVE COVER FOR CAMOUFLAGING A HOOK ASSOCIATED WITH A PLANT HANGING SUSPENSION DEVICE

(76) Inventors: Cathy D. Santa Cruz, 7630 Tholl Dr., Reno, NV (US) 89506; Edward A. Carwin, 1330 Jones St., Reno, NV (US) 89703

( * ) Notice: Subject to any disclaimer, the term of this patent is extended or adjusted under 35 U.S.C. 154(b) by 316 days.

(21) Appl. No.: 11/636,303

(22) Filed: Dec. 9, 2006

(65) Prior Publication Data

US 2008/0135710 A1 Jun. 12, 2008

(51) Int. Cl.
*A47H 1/10* (2006.01)

(52) U.S. Cl. ..... 248/328; 248/327

(58) Field of Classification Search ..... 248/327, 248/328, 329, 330.1; 211/113, 117–119, 211/85.3; 242/382.6; 47/67, 29.5
See application file for complete search history.

(56) References Cited

U.S. PATENT DOCUMENTS

| | | | | |
|---|---|---|---|---|
| 3,740,123 | A * | 6/1973 | Leitl | 359/855 |
| 4,102,308 | A * | 7/1978 | Kilham | 119/52.3 |
| 4,117,630 | A * | 10/1978 | Kalas | 47/67 |
| 4,523,357 | A * | 6/1985 | Widditsch | 24/600.9 |
| 6,230,436 | B1 * | 5/2001 | Givens | 47/29.5 |

* cited by examiner

*Primary Examiner*—Gwendolyn Baxter

(57) ABSTRACT

Provided herein is a novel decorative cover that is used for camouflaging a hook concealed therein. The decorative cover is aesthetically pleasing and truly accentuates the beauty of the plant as opposed to being an unsightly distraction. The cover can be easily used with various types of fastening members and each can be interchanged according to the users wishes. Furthermore, the preferred fastening member is adjustable in height and also is interconnected onto a swivel. Whereby, the user can manually rotate the plant to promote overall even growth resultant from regulated exposure to the sunlight.

12 Claims, 1 Drawing Sheet

DECORATIVE COVER FOR CAMOUFLAGING A HOOK ASSOCIATED WITH A PLANT HANGING SUSPENSION DEVICE

FIELD OF THE INVENTION

A decorative cover that is used to camouflage a prior art suspension hook typically sold in combination with a potted plant at the point of purchase. Such suspension hooks include three support members that are attached onto the plant's pot and also interconnected onto the suspension hook. The support members are not terribly unappealing but the suspension hook itself is extremely aesthetically unpleasant and a true eyesore. Thus when viewed, the suspension hook greatly diverts ones attention away from appreciating the natural beauty of the plant and this is most unfortunate. Therefore, the present decorative cover resolves this issue as it not only camouflages the hook but the cover itself is a pleasant variant and a conversational piece.

BACKGROUND OF THE INVENTION

It is well known that hanging plants are extremely popular and are commonly displayed both indoors and outdoors. Plants are not only displayed for beautifying of their surroundings but also for creating oxygen of which is most beneficial and inherently increases ones health. Most plants are displayed for beauty and inspired admiration thereof. As a result the means for suspending the plant should not distract or divert attention there from. More importantly, the suspension means should not be unsightly. Unfortunately, most hanging plant suspension means include a hideous hook and this needs to be addressed and resolved.

Heretofore, hanging plant suspension means have addressed and recognized numerous disadvantages typically associated therewith. For example, U.S. Pat. Nos. 5,065,971, 4,220,306, 5,052,148, 5,077,936 and 5,360,193 all pertain to various means for adjusting the height of the plant. This is an advantage as suspended hanging plants should be adjustable in height, so as to be easily displayed at different locations and/or usable with ceilings of various heights. These references are useful for their intended purpose, but each still do not address camouflaging of the hook and this is most desirable. In fact it would be most beneficial if the present invention were to be combined with the existing prior art to enhance performance thereof. Namely, to aesthetically improve each of the inventions.

Still further prior art addresses the fact that it is an advantage to allow for rotation of the suspended plant. This is an important feature as this encourages the plant to grow uniformly as opposed to growing lopsided. Such prior art includes U.S. Pat. Nos. 5,546,698 and 4,46,653. However, again they still include use of a hideous distracting suspension hook or the like.

It appears that nowhere in the prior art (known to the applicants) do they address, recognize, or attempt to resolve the issue at hand. Namely, to camouflage the unsightly suspension hook associated with potted plants when purchased having the standard hanger device.

Thus, there is a great need for improving the aesthetic properties of typical plant hangers as those currently available all include some type of suspension hook that is extremely distracting and most displeasing to the viewer.

OBJECTS AND ADVANTAGES OF THE PRESENT INVENTION

It is therefore a primary object of the present invention to provide a new decorative cover that is used for camouflaging "in an aesthetically pleasing manner" a standard suspension hook typically associated with a plant-hanging device.

It is another important object of the present invention is to provide a decorative cover that can be easily slidably engaged over the standard suspension hook. Whereby the decorative cover and the suspension hook are not attached together.

Yet another important object of the present invention is to provide the decorative cover with ornamentation thereon that enhances the aesthetic appearance. For example, the ornamentation can be flowers, animals, raindrops, holiday related items, or anything else that is imaginable.

Also another object of the present invention is to provide optional features that are pleasing to the end user. For example, if so desired the decorative cover may be sold as a kit having numerous covers that may be easily interchanged. This is most advantageous as the user can pick and choose which covers are to be displayed for various occasions or the like. This option may be more appealing as the user can have fun changing the covers, such as one may be a Christmas tree for the holiday, a baby related item for a baby shower, a bridal gown for a wedding, etc. This also reduces boredom if the user is tired of looking at the same cover everyday.

Still a further object of the present invention is to provide the option that the cover may be manufactured having interchangeable accessory ornaments. For example, the cover may be made from plastic having an elongated aperture and the accessory ornament device may have an elongated flange that is frictionally engageable with the aperture. Whereby, the accessory ornaments can be easily interchanged with only one cover.

Yet another object of the present invention is to provide adjustment means for varying the length of the fastener that suspends the cover and hook from the ceiling hook.

Also another important object of the present invention is to provide swivel means that allows the user to easily rotate the plant between various positions of choice.

Other objects and advantages will be seen when taken into consideration with the following specifications.

DETAILED DESCRIPTION OF THE DRAWINGS

Referring now in detail to the drawings wherein like characters refer to like elements throughout the various views. It is to be noted the most important feature of the present invention is that it teaches a novel decorative cover for camouflaging a hook associated with a plant-hanging device. It is to be understood the present invention can be used with any pre-existing plant-hanging device of choice that includes a suspension hook.

Within FIGS. 1-4, (10) represents a general overview of the present invention. As taught within the previous specification the general concept for the invention includes the following. Namely, a decorative cover (12) that is used for camouflaging a prior art suspension hook (14) associated with a prior art plant-hanging device.

With reference to the decorative cover (12) it is to be understood that it can be made from any suitable material of engineering choice. For example, including but not limited too, wood, plastic, ceramic, rubber, etc. Furthermore, the shape of the decorative cover (12) is not to be limited to any specific shape or design. Thus, the substantial bell-shape as depicted herein is only exemplary of one possible shape. This is an important factor as the decorative cover (12) includes numerous optional alternatives. Namely, the decorative cover (12) can be fixedly attached and sold with the other components. Or the decorative cover can be manufactured and sold as a kit providing variable shapes/decorations of engineering choice, and/or multiples may be purchased so as to allow the user to interchange the decorative covers to their liking and individual needs. For example, the decorative covers may include an assortment of holiday decorations that are interchangeable according to the holiday. For example, the covers may be in the form of a pumpkin for Halloween, a Santa Clause for Christmas, etc. Other options are to include specific artistic variations, such as the covers may be hand-painted, include glitter, glow in the dark, or the like, they may even become valuable collector items. However, the size of the decorative cover is somewhat limited as it must be large enough to completely camouflage the suspension hook (14) when positioned therein.

Figure 1:
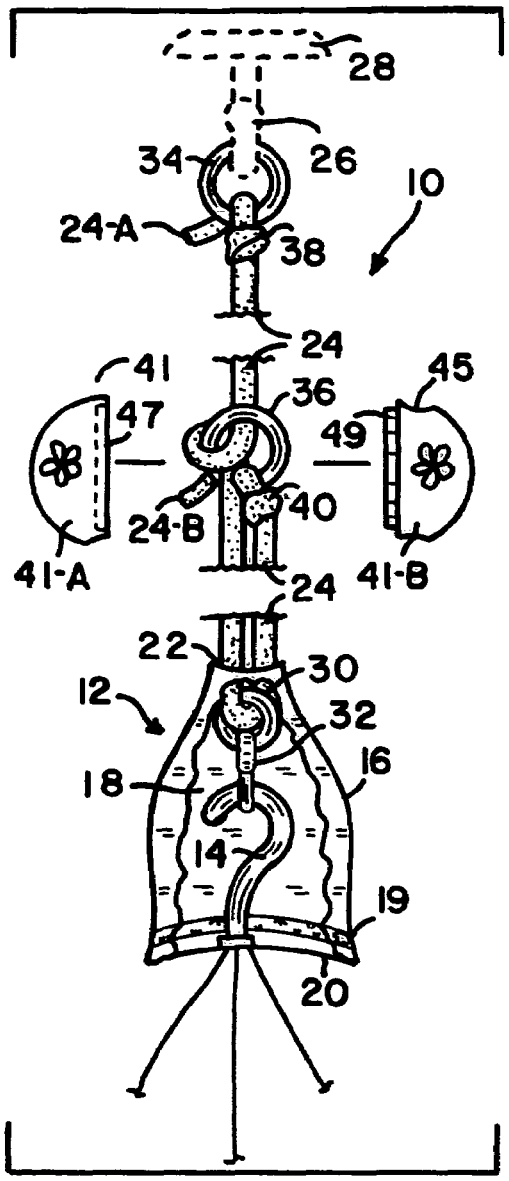
FIG. 1 is substantially a plan overview depicting a first embodiment for the present invention.
Figure 2:
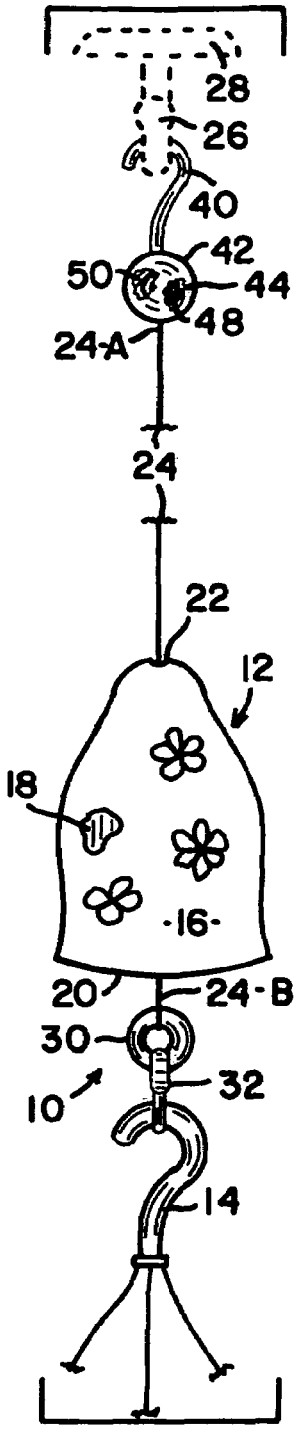
FIG. 2 is substantially plan overview depicting a second embodiment for the present invention.

Therefore, the decorative cover (12) substantially includes a housing (16) that is partially cutaway in FIG. 1, but is fully depicted in FIG. 2. The housing (16) has an interior compartment (18), an enlarged bottom opening (20), and a centralized smaller upper opening (22). The enlarged bottom opening (20) is large enough to easily accept the suspension hook structure (14) there through which allows for complete concealment of the suspension hook structure (14) within the interior compartment (18). However, if preferred the decorative cover (12) may be made from cloth and the enlarged bottom opening (20) may further include an adjustable closure means of engineering choice. For example, the adjustable closure means may be a drawstring, elastic (19) or the like. Whereby after the suspension hook structure (14) is inserted upward through the enlarged bottom opening (20) and positioned within the interior compartment (18) the adjustable closure means (19) can be adjusted resulting in gathering of the cloth around a lower portion of the hook structure (14).

The invention further includes a fastening member having an elongated body portion (24), a first end (24-A) and a second end (24-B). It is to be noted the fastening member (24) can be made from an endless variety of materials of engineering choice, including but not limited too; cloth, string, rope, plastic, metal, rubber, fishing line or the like.

The general concept of the present invention further includes the fastening member (24) being removably attachable onto any type of an above support structure. For example, as depicted in FIGS. 1 and 2, the above support structure is a ceiling hook (26) that is installed onto a ceiling (28) The ceiling hook (26) and the ceiling (28) being shown in ghost lines as each are considered to be prior art. The centralized upper opening (22) of the decorative cover housing (16) is of a size to slidably removably receive the elongated body portion (24) of the fastening member there through. The centralized upper opening (22) may slightly vary in size depending on the type of fastener it is interconnected to. For example, in FIG. 1 the centralized upper opening (22) is large enough to allow for the elongated body portion (24) to be inserted therein and throughout. However, in FIG. 2 the centralized upper opening (22) need only be large enough for the elongated body portion (24) to be threadably inserted only once.

The general concept further includes that the fastening member is interconnected onto a stop assembly of which is of a size larger than the centralized upper opening (22). This allows for the housing (16) to be vertically slidable upon the elongated body portion (24) when installed above the stop assembly but when lowered will rest upon the stop assembly. For illustrative purposes, the housing (16) is shown in a lowered position in FIG. 1, and is shown in an upward position within FIG. 2 so as to illustrate the slid ability thereof.

It is again to be noted that various types of stop assemblies can be incorporated depending on engineering choice. Thus the invention is not to be limited to any specific type of stop assembly. However, the stop assembly includes attachment means for removably attaching the hook structure (14) thereto. Therefore a circular ring design is most functional as this provides use with variable attachment means of choice. It can now be seen the housing (16) of the decorative cover (12) functions as an aesthetically pleasing decorative cover that is functional for camouflaging the hook structure (14) when positioned therein.

In the preferred embodiments as depicted herein, the attachment means for removably attaching the hook structure (14) onto the stop assembly (30), is a swivel (32) of which is most advantageous. It is to be noted the swivel (32) can be any standard type (prior art) of swivel mechanism, such as those associated with fishing tackle, or the like. Furthermore, the swivel can be installed onto the fastening member at any other desirable location such as onto the uppermost end of the fastening member, or the like. Whereby, the hook structure (14) can be easily rotated. This is very important as this allows the user to rotate and reposition the plant for variable exposure to the sunlight so as to eliminate lopsided growth thereof.

Furthermore, another optional advantage for the present invention is to include adjustment means for variably adjusting the length of the fastening member (24). Again, numerous types of adjustment means can be incorporated depending on engineering choice. Thus, the following specification is only exemplary and describes two possible types of adjustment means but the invention is not limited thereto.

Referring now to FIG. 1, wherein the noted adjustment means includes a first attachment bracket (34) and a second attachment bracket (36). The second attachment bracket (36) as depicted has an exterior perimeter and an internal parameter. The first end (24-A) of the fastening member is fixedly attached onto the first attachment bracket (34) by any suitable attachment means of choice, such as by simply tying a knot (38) or the like. The elongated body portion (24) is then threadably inserted into the internal parameter then wrapped about the exterior perimeter. Thereafter the elongated body portion (24) is threadably inserted back into the internal parameter and outwardly there from, then downwardly into the centralized smaller upper opening (22), then into and throughout the stop member (30), upwardly and outwardly back through the centralized smaller upper opening (22) and then the second end (24-B) is fixedly attached onto the second attachment bracket (36) by any suitable attachment means, such as by a knot (40). Whereby, it can now be seen the elongated body portion (24) can be easily manually adjustably threadably engaged into and throughout the second attachment bracket (36) for variably adjusting the length of the elongated body portion (24).

As another option for the above embodiment it may be desirable to further include an additional ornamental member (41) that is removably attachable onto the second attachment bracket (36) for camouflaging the second attachment (36) as well. Again, the additional ornamental member (41) maybe made from various materials of engineering choice and/or also formed into any appropriate shape or size. Thus, the additional ornamental member (41) as depicted herein is only exemplary of one possible embodiment. For example, in FIG. 1 the additional ornamental member (41) is in the form of a hollow ball that is cut in two, forming a first half (41-A) and second half (41-B). The first half (41-A) having attachment means for interconnecting the first half onto the second half (41-B). As can be seen the first half and the second half when combined form a lower opening (43) and an upper opening (45) and each opening (43 & 45) in combination allow for the elongated body portion (24) to be threadably engaged there through. It is to be understood any suitable attachment means for interconnecting each half section (41-A & 41-B) may be incorporated thus the following attachment means is again only exemplary. As further illustrated in FIG. 1, the first half section (41-A) includes a recessed internal circular lip (47) (shown in ghost lines) and the second half (43-B) includes a protruding circular lip (49). Whereby, the recessed internal circular lip (47) can frictionally retain the protruding circular lip (49) therein. Yet another option for the additional ornamental member (43) is to integrally form as one unit both the additional ornamental member (43) with the second attachment bracket (36) in combination, thus camouflaging said second attachment bracket.

Figure 3:
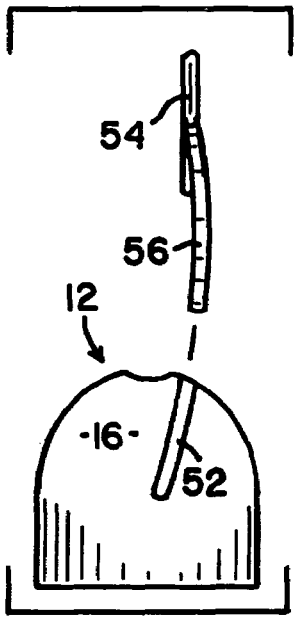
FIG. 3 is substantially a right side plan view of the present decorative cover having an interchangeable accessory ornament device.

Referring now to FIG. 3 wherein an alternative adjustment means for variably adjusting the length of the elongated body portion (24) is depicted. Namely, the invention further includes a casing (42) having an internal storage area (44) and attachment means for removably attaching the casing (42) onto the above support structure (28), such as by a fixedly attached hook (44). It is to be noted in this embodiment the fastening member (24) is preferably made from fishing line. This is most advantageous as it is most functional and more importantly being the fishing line is transparent it does not distract ones attention from the decorative cover and/or the plant. The first end (24-A) of the fastening member (24) is interconnected onto a standard extension spool (48). The extension spool (48) is contained within internal storage area (44) and the extension spool (48) includes a locking mechanism (50). It is to be noted the actual locking mechanism and extension spool are well known within the prior art so the workings thereof are not herein taught. For example, a standard type of extension spool with locking mechanism is exemplified by a typical re-tracking tape-measurer. In use, the tape-measurer (or fastening member 24) can be manually pulled from within the casing (42) until it is of the desired length. The locking mechanism (50) then stops the fastening member (24) when manually released. Thereafter, when a user tugs upon the fastening member (24), the locking mechanism (50) automatically retracts the fastening member (24) back into the casing (42). Thus, the fastening member (24) can be retracted into and out of the internal storage area (44) via the extension spool (48) and the fastening member (24) can be variably adjusted to different heights then locked into a position of choice via the locking mechanism (50).

Figure 4:
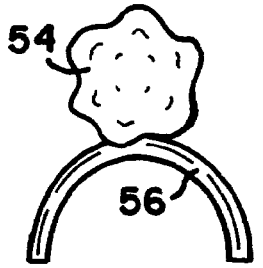
FIG. 4 is a front view of the interchangeable accessory ornament device when detached.

Referring now to FIGS. 3 and 4 wherein we depict another optional feature for the present invention. Namely, the housing (16) for the decorative cover (12) is preferably made from plastic such as by plastic mold injection or the like. The housing (16) further includes attachment means for removably attaching an accessory ornament device thereon. It is to be noted various types of attachment means may be incorporated dependant upon engineering choice. Therefore the following attachment means is only exemplary and the invention is not to be limited thereto. As depicted herein, the attachment means for removably attaching an accessory ornament device thereon includes the housing (16) having an elongated aperture (52) and the accessory ornament device (54) includes an elongated protruding flange (56) that is frictionally engageable within the elongated aperture (52). Whereby, it can be seen that various types of accessory ornaments can be interchanged according to the users needs. Again the accessory ornaments can be sold as a kit having different styles and variety's of which the user can pick and choose.

It will now be seen we have herein provided a new and novel decorative cover for camouflaging a hook associated with a plant-hanging device. The decorative cover truly accentuates the beauty of the plant rather than detracting there from. Furthermore, the decorative covers and the fastening member can each be made from various materials of choice. More importantly the decorative cover and fastener can be interchanged and sold as a kit so as to provide various styles for variety and interchangeable fun options.

Although the invention has been herein shown and described in what is conceived to be the most practical and preferred embodiment, it is recognized that departures may be made there from within the scope and spirit of the invention, which is not to be limited to the details disclosed herein but is to be accorded the full scope of the claims so as to embrace any and all equivalent devices and apparatuses.

Having described our invention, what we claim as new and desire to secure by Letters Patent is:

1. A decorative cover for camouflaging a hook associated with a plant-hanging device comprising: a housing having an interior compartment; an enlarged bottom opening; and a centralized smaller upper opening; said enlarged bottom opening being large enough to easily accept a hook structure there through which allows for concealment of said hook structure within said interior compartment, a fastening member having an elongated body portion, a first end and a second end, said fastening member being removably attachable onto an above support structure, said fastening member includes adjustment means for variably adjusting the length thereof, said centralized upper opening being of a size to slidably removably receive said elongated body portion there through, said fastening member being interconnected onto a stop assembly, said stop assembly being of a size larger than said centralized smaller upper opening, said housing being vertically slidable upon said elongated body portion when said housing is installed above said stop assembly, and said stop assembly having attachment means for removably attaching said hook structure thereto, whereby, said housing functions as an aesthetically pleasing decorative cover for camouflaging said hook structure.

2. The decorative cover for camouflaging a hook associated with a plant-hanging device of claim 1 wherein said stop assembly having attachment means for removably attaching said hook structure thereto is a swivel, whereby said hook structure can be easily rotated.

3. The decorative cover for camouflaging a hook associated with a plant-hanging device of claim 1 further includes said above support structure being a ceiling hook, said adjustment means comprising: a first attachment bracket, a second attachment bracket, said second attachment bracket having an exterior perimeter and an internal parameter, said first end being fixedly attached onto said first attachment bracket, said elongated body portion being threadably inserted into said internal parameter then wrapped about said exterior perimeter then threadably inserted back into said internal parameter then outwardly there from downwardly into said centralized smaller upper opening, into and throughout said stop member, upwardly and outwardly through said centralized smaller upper opening and then said second end being fixedly attached onto said second attachment bracket, whereby, said elongated body portion can be adjustably threadably engaged into and throughout said second attachment bracket for variably adjusting said length of said elongated body portion.

4. The decorative cover for camouflaging a hook associated with a plant-hanging device of claim 3 further includes an additional ornamental member that is removably attachable onto said second attachment bracket for camouflaging said second attachment bracket.

5. The decorative cover for camouflaging a hook associated with a plant-hanging device of claim 4 wherein said additional ornamental member comprising: a hollow ball cut in two forming a first half and a second half, said first half having attachment means for interconnecting said first half onto said second half, said first half and said second half in combination form a lower opening and an upper opening, and each said opening in combination allow for said elongated body portion to be threadably engaged there through.

6. The decorative cover for camouflaging a hook associated with a plant-hanging device of claim 3 further includes an additional ornamental member that is integrally formed with said second attachment bracket contained therein, thus camouflaging said second attachment bracket.

7. The decorative cover for camouflaging a hook associated with a plant-hanging device of claim 1 wherein said fastening member can be made from a variety of materials, including cloth, string, rope, plastic, metal or rubber.

8. The decorative cover for camouflaging a hook associated with a plant-hanging device of claim 1 further includes said housing being made from plastic, said housing including attachment means for removably attaching an accessory ornament device thereon, last said attachment means including said housing having an elongated aperture and said accessory ornament device having an elongated protruding flange that is frictionally engageable within said elongated aperture.

9. The decorative cover for camouflaging a hook associated with a plant-hanging device of claim 1 wherein said adjustment means comprising: a casing having an internal storage area, said casing having attachment means for removably attaching said casing onto said above support structure, said first end of said fastening member being interconnected onto an extension spool, said extension spool being contained within said internal storage area, said extension spool having a locking mechanism, thus said fastening member can be retracted into and out of said internal storage area via said extension spool and said fastening member can be variably adjusted to different heights then locked into a position of choice via said locking mechanism.

10. The decorative cover for camouflaging a hook associated with a plant-hanging device of claim 9 wherein said fastening member is made from fishing line.

11. The decorative cover for camouflaging a hook associated with a plant-hanging device of claim 1 wherein said decorative cover is further made from cloth and said enlarged bottom opening further includes adjustable closure means, whereby after said hook structure is inserted upward through said enlarged bottom opening and positioned within said interior compartment, said adjustable closure means can be adjusted resulting in gathering of said cloth around a lower portion of said hook structure.

12. The decorative cover for camouflaging a hook associated with a plant-hanging device of claim 11 wherein said adjustable closure means is elastic.

* * * * *